United States Patent [19]

Haedo

[11] Patent Number: 4,549,764

[45] Date of Patent: Oct. 29, 1985

[54] FLEXIBLE CHAIR BACK

[75] Inventor: Edmundo Haedo, Chicago, Ill.

[73] Assignee: K. L. Spring & Stamping Corporation, Chicago, Ill.

[21] Appl. No.: 532,216

[22] Filed: Sep. 14, 1983

[51] Int. Cl.[4] ..... A47C 3/00

[52] U.S. Cl. ..... 297/296; 297/306; 248/629

[58] Field of Search ..... 297/296, 306; 248/622, 248/627, 630, 629, 599; 403/291, 292

[56] References Cited

U.S. PATENT DOCUMENTS

| | | | |
|---|---|---|---|
| 2,587,822 | 3/1952 | Corning | 403/292 |
| 2,732,005 | 1/1956 | Corning | 297/306 |
| 2,828,801 | 4/1958 | Papst | 248/629 |
| 4,084,850 | 4/1978 | Ambasz | 297/306 |
| 4,340,250 | 7/1982 | Ward | 248/629 |

FOREIGN PATENT DOCUMENTS

| | | | |
|---|---|---|---|
| 2619538 | 11/1977 | Fed. Rep. of Germany | 297/296 |

*Primary Examiner*—Francis K. Zugel

*Attorney, Agent, or Firm*—Lee, Smith & Zickert

[57] ABSTRACT

A resilient spring insert insertable into the separated ends of a chair backrest tubular frame to provide flexible movement of the backrest with respect to the seat. The spring insert is comprised of two carbon steel straps overlying each other and integrally joined together at the ends. Near the ends thereof each strap is bent outwardly in an arch-like manner such that when joined a hollow enclosure is formed. A nylon fastening block with a central hole is placed into the hollow enclosure. The hollow enclosure at each end of the spring insert fits snugly into a severed end of the tubular frame. A fastening screw is passed through a hole in the chair frame and self-threads into the block thereby securing that end of the spring insert to the associated separated frame end.

10 Claims, 2 Drawing Figures

FLEXIBLE CHAIR BACK

BACKGROUND OF THE INVENTION

The present invention relates generally to furniture, and more particularly to chairs having backrests.

The public acceptance and the commercial success with which furniture in general experiences is due, in a large part, to the amount of comfort it provides to the user. The quality, kind and shape of materials with which furniture is constructed thus plays a large part in the comfort quality of furniture, as well as its aesthetic appeal.

One problem which remains a challenge to the furniture industry is to produce an inexpensive chair which provides a high degree of comfort, especially to a user who has occasion to sit on the chair for extended periods of time. This problem manifests itself in a variety of situations such as large conference rooms or auditoriums, where, because of the large number of seats required, an object is to minimize expense as well as provide a comfortable chair. The comfort quality of a chair depends, to a large extent, upon the type and shape of back rest as this aspect is generally the first cause of discomfort to the user.

Because general purpose chairs are constructed with backrests fixed to the seat structure, a person sitting upon the chair is constrained in that position thereby restricting the movement of the user. There is therefore a need for an inexpensive chair with a backrest flexible to an extent which allows the user to alter his upright sitting position and thereby prolong the period of time by which he can comfortably use the chair.

It is therefore an object of the present invention to provide a general purpose chair in which the backrest portion thereof is movable with respect to the seat portion.

It is another object of the present invention to provide a general purpose chair in which one portion of the backrest is movable with respect to the other portion of the backrest.

It is a further object of the present invention to provide a method for converting stiff-backed chairs to chairs with flexibly movable backs.

SUMMARY OF THE INVENTION

In accordance with the invention there is provided a chair with a backrest having a resilient support structure which permits the backrest to be flexibly moved from its neutral position and thereby allow the user to alter his sitting position and thus relieve back strain normally associated with extended periods of sitting.

Specifically, in the tubular upright support members of the chair backrest there is inserted a resilient spring element for permitting one portion of the backrest to flexibly move with respect to the other portion. More particularly, general purpose chairs having a pair of tubular upright supports for supporting the cushioned backrest are manufactured in accordance with this invention with the upright supports in two separate sections and into which the ends of the pair of spring elements are inserted to resiliently connect one such section to the other. Alternatively, in existing chairs the upright supports may be severed and a pair of spring elements inserted therein to accomplish the same result.

The resilient element inserted into each upright support is comprised of two high carbon steel straps laminated together at their mid-sections and welded together at the ends thereof to form an integral spring unit. Near the spring element ends the two straps are spaced apart sufficiently to form an enlarged hollow section to snugly conform to the inside shape of the separated top and bottom tubular support structure ends. Into this hollow section is inserted a nylon block with a central bore for fastening the top section of the separated chair back support. Into the hollow section located at the other end of the spring element is inserted a similar block for fastening thereto the bottom section of the separated back support.

With one such laminated spring element installed in both upright support members of the chair backrest, the upper portion of the backrest can be flexibly moved with respect to the bottom portion.

DETAILED DESCRIPTION OF THE PREFERRED EMBODIMENT

Figure 1:
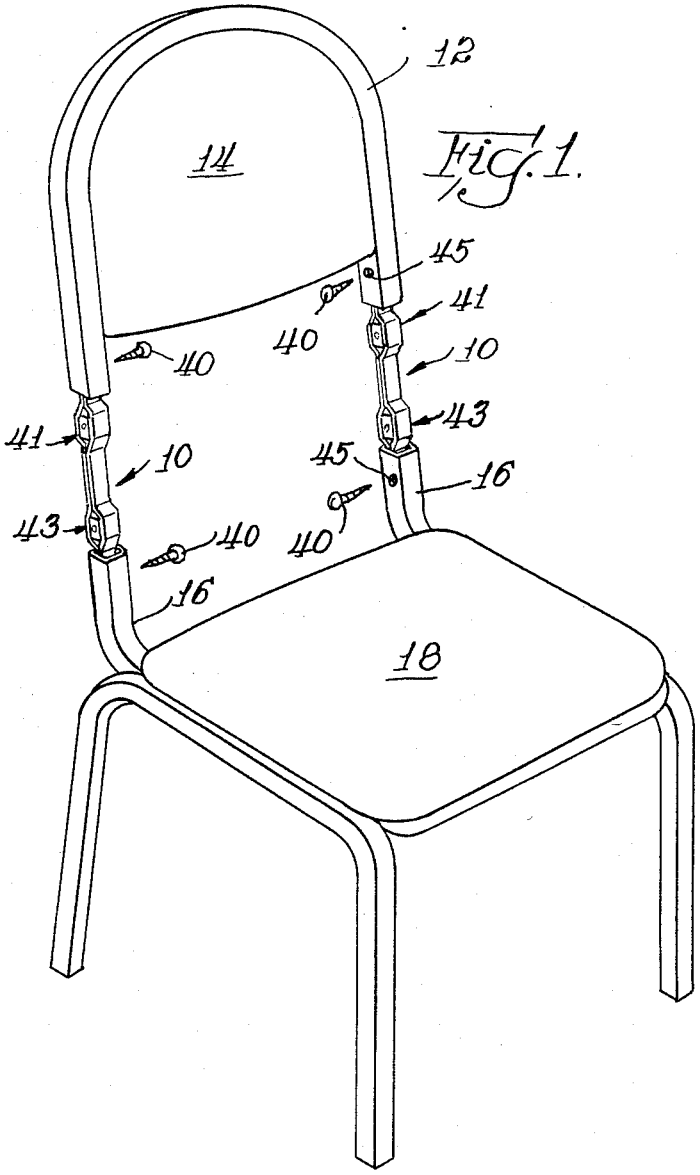
FIG. 1 is an isometric view of a general purpose chair showing the backrest portion thereof removed from the seat portion, and a resilient spring member according to the invention inserted into each tubular support member.

FIG. 1 illustrates the practical utility of the present invention when used with a square tubular framed chair. While the chair shown is for illustrative purposes only, it should be understood that the principles of the present invention may be employed with equal advantage to other types of chairs with support frames having different cross-sectional configurations.

The spring insert, generally designated by reference character 10, is constructed to snugly fit into the tubular frame support 12 of the chair backrest 14, and also into the corresponding tubular frame support 16 of the chair seat portion 18. Chairs adapted to utilize the present invention may either be manufactured with separate seat 18 and backrest 14 components, or as noted before, existing chairs may be fitted with the spring insert 10 by cutting the tubular support members which join the seat and backrest portions.

As will be discussed in more detail below, fastening screws 40 secure each end of the severed frame tubular support to the spring insert 10. In the preferred embodiment of the present invention the chair is shown with its frame constructed such that the entire backrest portion 14 is made flexibly movable with respect to the seat portion 18. In other applications of the invention those skilled in the art may prefer to construct or sever the tubular frame supports such that the backrest is made flexibly movable at a different location.

Figure 2:
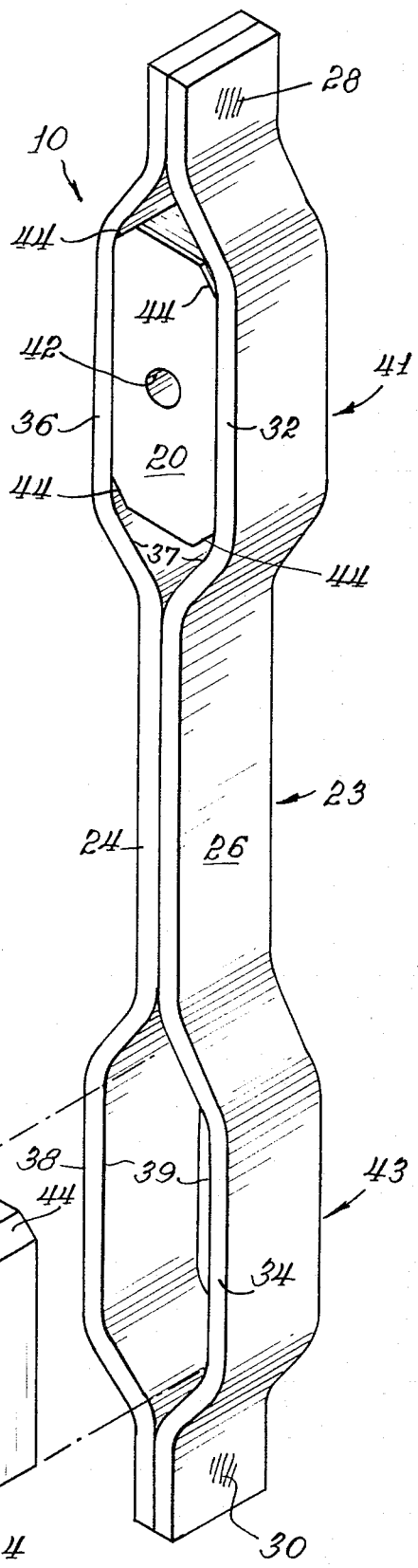
FIG. 2 is an isometric view of the laminated spring member according to the present invention with one fastening block removed from the hollow section thereof.
Figure 2:
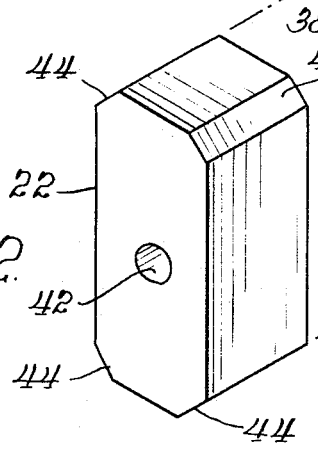

With reference now to FIG. 2 there is shown the spring insert 10 with a pair of associated fastening blocks 20 and 22. For reliability and resiliency, the spring insert 10 is constructed of two high carbon steel straps 24 and 26 laminated together at their mid-sections, and joined at the ends thereof by spot welding 28 and 30. The straps 24 and 26 are thus made integral only at the ends thereby permitting the one strap 24 to slidably move with respect to the other strap 26 at the mid-sections during flexing.

In the particular chair of the preferred embodiment the steel straps 24 and 26 are approximately 6.5 inches long, one-half inch wide and 0.093 inch thick. One steel strap 26 has formed proximate each end thereof arch-like formations 32 and 34 such that when joined with the other strap 24 having similar formations 36 and 38, a pair of hollow sections 37 and 39 are formed. Respective hollow sections 37 and 39 house fastening blocks 20 and 22. The outer part of the spring insert hollow sections comprise enlarged sections 41 and 43. Each fastening block 20 and 22 has chamfered corners 44 to accommodate the smoothly curved inside radius of the hollow section corners.

It should be understood that each enlarged section 41 and 43 is externally dimensioned to snugly fit within the respective backrest tubular frame support 12 and seat frame support 16. The primary function of such enlarged sections 41 and 43 is to provide a base which fills the interior of the tubular frame supports into which it fits. As noted before, the flexing motion of the spring insert 10 occurs along its laminated mid-section 23 rather than inside the frame supports. To that end, each fastening block 20 and 22 is constructed of nylon and includes a central bore 42 into which a screw 40 (FIG. 1) is self-threaded after having been inserted through a respective frame support hole 45. This fastening method fixes the corresponding part of the chair frame support to the spring insert 10. Because the enlarged sections 41 and 43 are somewhat elongate, movement of the spring insert 10 within its respective tubular frame support is prevented and thus only one fastening screw 40 is required for each spring insert end.

The spring insert 10 of the present invention can also be easily retrofit into an existing chair by simply cutting each backrest upright frame support, drilling holes in each end of the cut frame support, and fixing a spring insert into the tubular supports by suitable fastening means. With the use of the spring insert 10 a large number of chairs can be easily and economically converted without the need of replacing such chairs with the type which includes factory-installed spring inserts.

With reference again to FIG. 2, each steel strap 24 and 26 contacts the other in a laminate manner at its mid-section 23. With the provision of two strap members 24 and 26, an integral unit with a pair of hollow sections 37 and 39 is advantageous for two reasons. First, the bending of the two arch-like formations 32 and 36, together with the nylon fastening block 20 is much more cost effective, and lighter weight, than using solid bar metal material. Secondly, the two-piece spring insert 10 supplies a safety factor by enabling the unit to yet provide a flexible support connection, albeit a weaker connection, between the seat 18 and backrest 14 in the event one of the steel straps fractures and breaks.

To guard against metal fatigue due to the flexing of the spring insert straps 24 and 26, each strap is annealed 1095 steel, No. 1 round edge, and heat treated to a hardness of 50–55 R.C. In addition, the high carbon steel straps 24 and 26 are high intensity shot peened after heat treatment and are stressed and relieved 30 minutes at 500 degrees F. after shot peening has been completed.

Not shown in the drawings, and used for piloting purposes during manufacturing only, are drilled a pair of spaced-apart one-eighth inch holes into the mid-section 23 of the spring insert 10. While these holes may have an effect on the resiliency of the steel straps, it has been found through tests that such holes do not substantially contribute to fatigue areas. The pilot holes may be eliminated if other piloting methods are used.

In completing the factory installation, or the retrofitting of the spring inserts 10 into the upright backrest frame supports of a chair, holes 45 are drilled into the inside face of the tubular frame support 12, and comparably into the seat tubular frame support 16. The exposed head of the fastening means 40, being on the inside part of the chair reduces the likelihood that clothes will be caught thereon and torn. Holes 45 in the frame supports are somewhat larger than the holes 42 of the fastening blocks 20 and 22 so that a sheet metal screws 40 can freely pass through the frame supports 12 and 16 and self-thread into the respective fastening blocks 20 and 22. Of course, if the backrest portion 14 of the chair prevents access to the fastening block from the inside of the upright frame supports, the holes 45 may be drilled on the outer faces of the frame supports.

As noted before, the nylon fastening blocks 20 and 22 fit snugly into their respective hollow sections 37 and 39 such that the securement of the fastening blocks 20 and 22 to the chair frame provides a concomitant securement of that end of the spring insert 10 to the chair frame. To provide flexible movement to the fullest extent when converting on existing chair, a short section of either the backrest frame support 12 or the seat frame support 16 may be removed to thereby expose a greater part of the spring insert mid-section 23. Preferably, the cut ends of both the seat frame support 16 and the backrest frame support 12 are positioned on the respective enlarged sections 41 and 43 but do not overlap onto that part thereof which is bent downwardly toward the mid-section portion 23. In this manner, the cut ends of the backrest frame supports are flush with the enlarged sections 41 and 43 and thereby eliminate sharp corners which again, could catch and tear clothing.

In brief summary, the present invention includes laminated spring steel inserts which are insertable into each end of the backrest frame supports to allow the backrest portion thereof to be flexibly moved with respect to the seat portion and thereby reduce backstrain of a person sitting thereon. Aside from original equipment manufacture, the adaptability of the spring steel inserts to a conventional general purpose chair is easily accomplished by removing a portion of the backrest tubular frame support and inserting and fastening in each end thereof the enlarged sections of the spring insert. Since the preferred embodiment described herein may undoubtedly be modified by those skilled in the art without departing from the scope and spirit of the invention, the foregoing detailed description is intended to be merely exemplary and not restrictive of the invention as will now be claimed hereinbelow.

What is claimed is:

1. A spring element for use with a chair and insertable into the ends of a separated backrest frame support for allowing flexuous movement of the upper portions of said backrest frame support with respect to the lower portions thereof, said spring element comprising:

a pair of elongate spring members joined together with their medial portions in abutting relationship and having end portions bent outwardly in generally parallel spaced apart relationship to form enlarged sections fittable with a different end of said separated backrest frame support, whereby the midsection of said spring element is resilient permitting flexuous movement of the upper portions of said backrest frame with respect to the lower portions thereof.

2. The backrest frame support spring element of claim 1 wherein each spring member of said pair is substantially identically shaped.

3. The backrest frame support spring element of claim 1 wherein each said spring member is integrally united with the other to form a unit.

4. The backrest frame support spring element of claim 1 wherein the outwardly bent end portions of each said spring member is bent back inwardly at the ends thereof and integrally joined together thereat.

5. The backrest frame support spring element of claim 1 further including means for fastening each said enlarged section to a separated end of said backrest frame support.

6. The backrest frame support spring element of claim 5 wherein said means for fastening includes a fastening block insertable into said enlarged section.

7. The backrest frame support spring element of claim 6 further including means for fastening said fastening block to said frame support.

8. In combination with a chair having a movable frame support carrying a backrest and having a pair of spaced apart frame members and a stationary frame support attached to the chair seat and having a pair of spaced apart frame members, a pair of spring units insertable into the ends of said movable and stationary frame supports, each of said spring units comprising;

a pair of elongate, flat spring members joined together with their medial portions abutting to form a thin resilient mid-section and having end portions spaced apart in generally parallel relationship to form enlarged end sections, said end sections being attached to the corresponding frame members of said frame supports, whereby said spring units will join said frame supports and permit flexuous movement of said movable frame support.

9. The improved chair of claim 8 wherein said movable and stationary frame supports are tubular and further including:

a fastening block snugly fittable into each of the enlarged end sections of said spring unit, and means for fastening said block to the tubular frame support into which said enlarged end section is inserted.

10. The improved chair of claim 9 wherein said frame supports are rectangular-shaped tubular supports and said enlarged section is shaped to snugly fit into the rectangular-shaped tubular frame supports.

* * * * *